United States Patent [19]

De Phillipo

[11] 4,015,106

[45] Mar. 29, 1977

[54] ELECTRONIC VOTING MACHINE

[75] Inventor: Thomas E. De Phillipo, Laurel Springs, N.J.

[73] Assignee: EVM Limited, Elkins Park, Pa.

[22] Filed: May 20, 1975

[21] Appl. No.: 579,147

[52] U.S. Cl. ..... 235/54 F

[51] Int. Cl.[2] ..... G07C 13/00

[58] Field of Search ..... 235/50 A, 50 B, 54 F, 235/56

[56] References Cited

UNITED STATES PATENTS

| | | | |
|---|---|---|---|
| 3,162,362 | 12/1964 | Jazbutis | 235/54 F |
| 3,710,105 | 1/1973 | Oxendine, Jr. et al. | 235/54 F |
| 3,722,793 | 3/1973 | Aronoff | 235/50 A |
| 3,739,151 | 6/1973 | Moldovan, Jr. et al. | 235/54 F |
| 3,779,453 | 12/1973 | Kirby et al. | 235/54 F |
| 3,787,662 | 1/1974 | Martin et al. | 235/54 F |
| 3,793,505 | 2/1974 | McKay et al. | 235/54 F |
| 3,847,345 | 11/1974 | Moldovan, Jr. et al. | 235/54 F |
| 3,941,976 | 3/1976 | Huhn | 235/54 F |

*Primary Examiner*—Stanley J. Witkowski
*Attorney, Agent, or Firm*—Gail W. Woodward

[57] ABSTRACT

A micro processor is connected to a switch operated voting panel and a vote selection indicating device. The voter-selected switch combination is converted to a digital code which is temporarily stored. The vote is recorded in a permanent form upon completion of voting in both a print-out and in an electronic memory. The electrical record can be connected to a communications system for remote tallying and continuous real-time remote readout. The automatic system is fully compatible with present machine voting systems.

6 Claims, 5 Drawing Figures

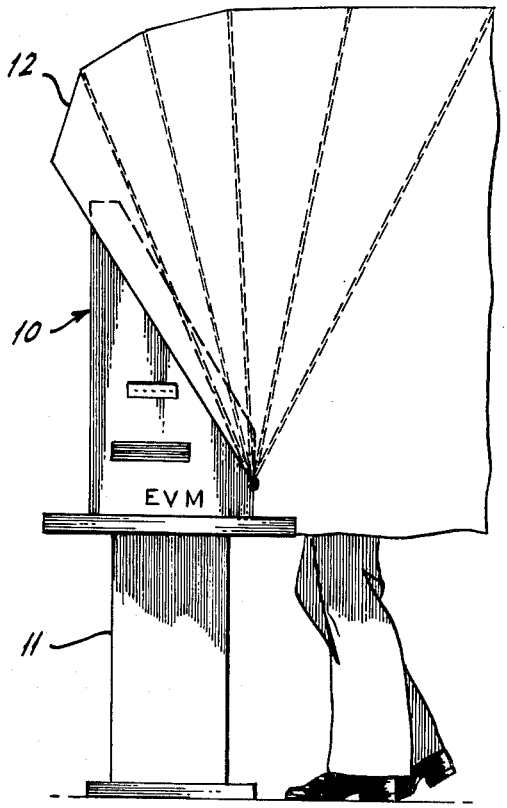
FIG. 1.
FIG. 2.
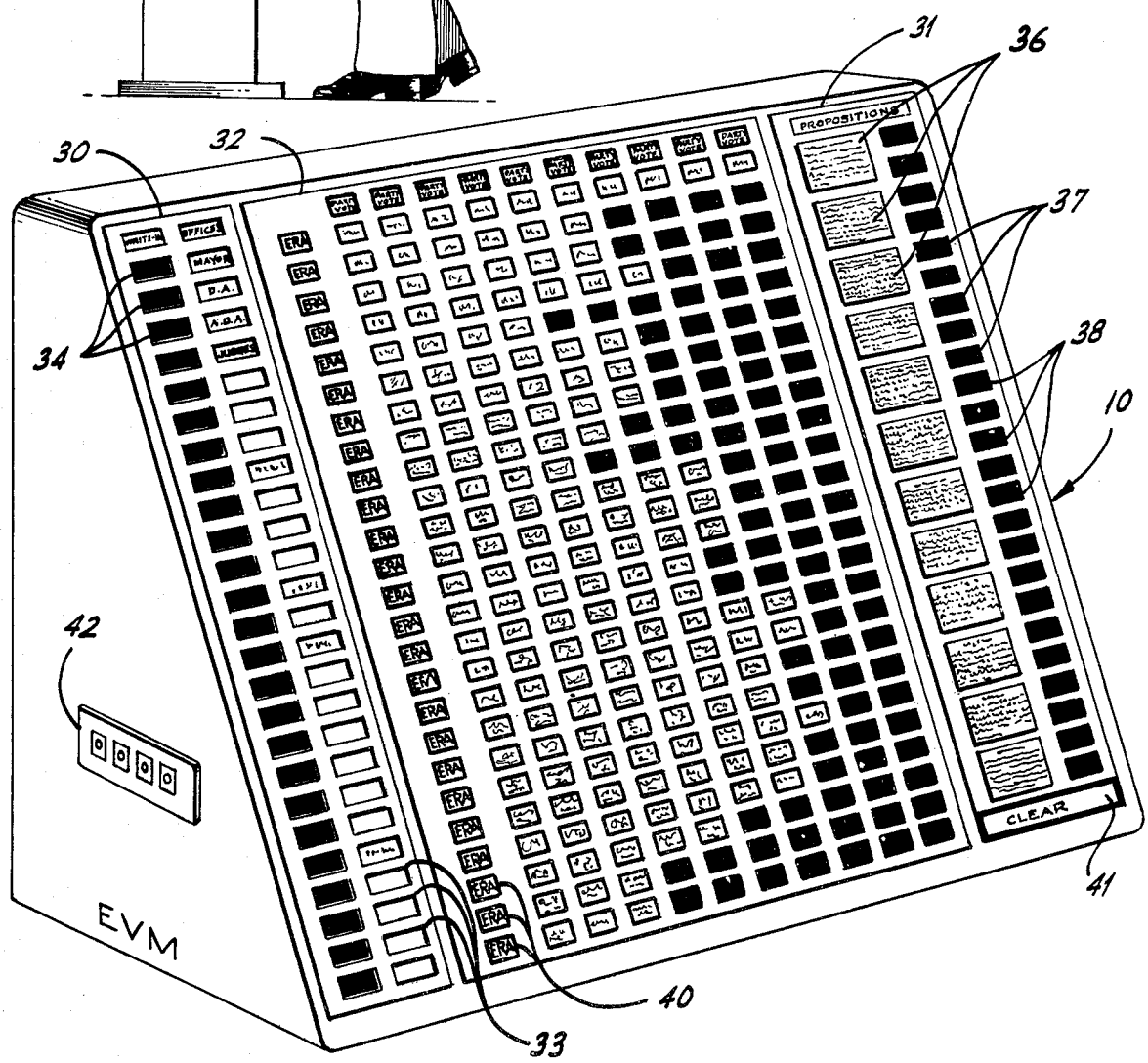

FIG. 4.
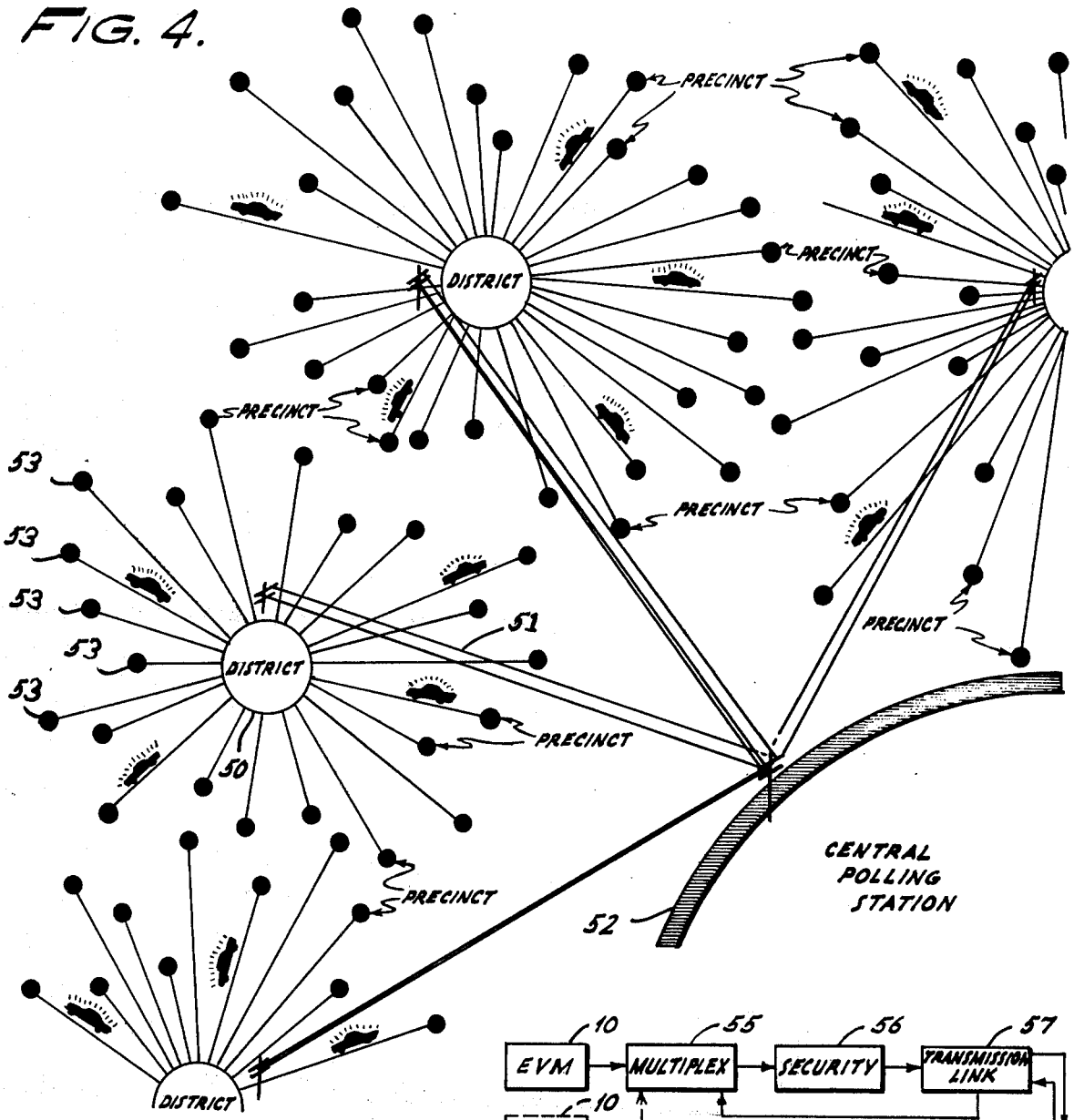
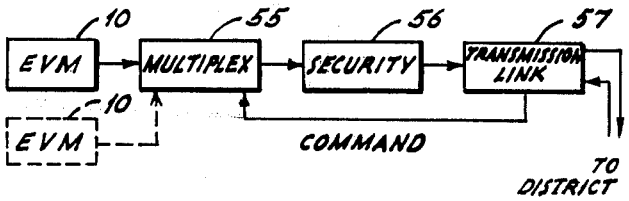
FIG. 5.
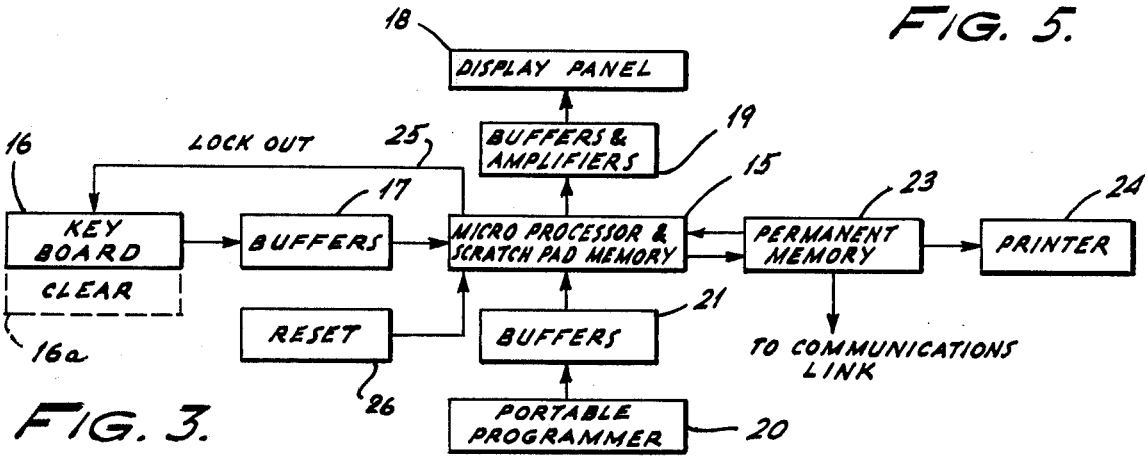
FIG. 3.

ELECTRONIC VOTING MACHINE

BACKGROUND OF THE INVENTION

Automated voting systems have long been desired but practical and social objections have largely prevented their widespread use. One of the main objections was eliminated by the advent of digital techniques where absolute accuracy in vote tallying is achieved. The modern mechanical voting machine represents the mechanical version of a digital recorder and processor.

Heretofore, electronic systems have been rejected for a number of reasons. While digital electronic machines have high reliability, they have been known to fail and such failures have been the object of much publicity. Furthermore, the electronic circuits involve a very large component count and therefore have been costly as well as open to the suspicion that the large scale use of electronic circuits is inherently untrustworthy.

The recent emergence of microelectronics and the development of Large Scale Integration (LSI) of electronic circuits has proven that very complex and extensive electronic circuitry can in fact be made cheaply, in very compact form, and capable of great accuracy. The proliferation of pocket calculators of quite complex design demonstrates the capability of digital electronic systems. Presently, micro processors can be obtained in quantity at very low cost. These Devices are actually scaled-down versions of computers with the scaling being done so that any given device can be programmed to perform a relatively wide range of operations. They have proven to be accurate, flexible and reliable and are presently being used in a wide variety of applications.

While electronic voting machines have provided suitable accuracy for voting machine applications, none of the systems proposed have been fully accepted. To be acceptable, such a system must of course be accurate and must be capable of integration into a system that covers a recognized political area. While many proposed systems fulfill these requirements, they are not acceptable because they do not comply with the statutory requirements of the areas they must serve. In addition, any new system must not depart excessively in terms of form, use and appearance from the older system it is to replace. Going from a written ballot to the presently used mechanical machine required a rather large social change and thus proved deceptively difficult to implement. However, that particular change has been accomplished and now there is resistance to evolving to a newer system. Accordingly, any new proposed system desirably will not involve a drastic change in system function and appearance, at least insofar as the voter is concerned.

SUMMARY OF THE INVENTION

It is an object of the invention to employ a micro processor and digital techniques in a voting machine that provides all of the political and social requirements of a voting system.

It is a further object of the invention to construct a voting panel that is familiar and readily acceptable to voters, but the actuation and display of the voting panel is in digital electronic form capable of being stored permanently and electronically read out as desired in a selected form.

It is a feature of the invention that, while a machine capable of ready voter acceptance is present, it is digitally electronically operated and therefore capable of a great range of electrical modes so as to be fully capable of any desired readout.

These and other objects and features are achieved in a system that is arranged and operated in accordance with the following.

A digital micro processor having an associated scratch pad memory is addressed by a keyboard operated by a voter casting a ballot. The keyboard comprises a panel of touch actuated switches. A display panel, which contains illuminating means operated by the micro processor, is used to indicate the voter selections. The panel is made to accomodate a transparent overlay upon which is printed the voting slate. The micro processor is programmed by voting attendants prior to an election and, at the same time, the transparent overlay is applied to the panel. The programming instructions are such that a particular digital code is generated in response to the voting. Operating the keyboard addresses a temporary or scratch pad memory and the selections are displayed on the panel as they are made. The micro processor contains instructions that permit the voter to change his mind and make alternative selections. A write-in vote device can also be incorporated into the system. When the write-in vote feature is invoked, the micro processor locks out the required number of selections for that particular elective office.

Once the voter is satisfied with his ballot, he operates a clear switch and the micro processor transfers the data in the scratch pad memory to a permanent memory. Also, if desired, a self contained printer can be made to record the vote on a paper tape for a permanent record. The clear operation, in addition to permanently recording the vote, locks the machine out until a voting attendant resets it in preparation for the next voter.

Using the above described arrangement, any machine could be used independently or it could be connected to a central vote tallying location by a simple communications link. The permanent memory can have its contents examined whenever desired at the central location. Thus a plurality of machines being used in a particular political area can be tallied to provide a continuous real-time read out of voting as it proceeds. At the termination of the voting period, the write-in votes are tallied and the written votes, along with the memory print outs, provide a permanent record of voting.

BRIEF DESCRIPTION OF THE DRAWING

FIG. 1 shows a voting booth in which the machine of the invention is used;

FIG. 2 is a view of the voting machine showing an arrangement of voting panel elements to provide a complete ballot;

FIG. 3 is a block diagram of the electronics of the system of the invention showing the interconnection of the various elements;

FIG. 4 is a simplified diagram showing how a number of electronic voting machines can be interconnected into a system having a central read out location; and FIG. 5 is a block diagram showing how the electronic voting machine is connected into a communications system.

DESCRIPTION OF THE INVENTION

FIG. 1 shows the setting in which the Electronic Voting Machine (EVM) is employed. A single voting booth, which could be one of a plurality of such units, is illustrated. The EVM 10 is located on a pedestal 11 of suitable height and which may be constructed to house associated electronic equipment if desired. An enclosure curtain 12 surrounds the face of EVM 10 and the voter, thus providing balloting secrecy. The curtain includes the usual mechanical opening and closing mechanism (not shown).

FIG. 2 shows the front panel of EVM 10. A transparent overlay covers the front of the device and conventional holding means, not shown, are provided to index the overlay with respect to the frame. The printing shown is applied to the overlay and portions thereof will change for each election. In setting up the EVM for an election, the voting attendants will apply the correct overlay to the face of the machine. At the same time, they will program the machine electronically in accordance with the data required for the election.

The panel shown in FIG. 2 combines a keyboard and display into a unitary structure. The face of EVM 10 comprises a series of illuminated windows and associated touch-sensitive switches. Clearly, the keyboard could be separated physically from the display panel, as is typically the case in a computer terminal. Regardless of the physical arrangement, when a particular switch is touched, the related panel window is illuminated and the selection thus made recorded in a temporary electronic memory. If a mistake is made or the voter changes his mind, the selection can be cancelled and another one made. As each selection is made, the temporary memory is addressed. When the ballot is completed, it is tallied by transferring the data in the temporary memory to a permanent memory and/or printed record. At this point, the keyboard operation is locked out until a voting attendant resets the machine upon entry of the next voter into the voting booth. In a typical system, a voter is verified by whatever means is being employed at the place of voting and allowed to enter the voting booth. After closure of curtain 12, the voting attendant resets the operation of EVM 10. The voter then proceeds to make his selection. The actual vote is cast when the selections are completed and can be made to occur as the voter either operates a switch in accordance with instructions or when he opens curtain 12 to leave the booth.

FIG. 3 is a block diagram showing the elements required to perform the above functions which will be explained in detail hereinafter.

The heart of the EVM is a micro processor 15 which includes a scratch pad or temporary memory section. A micro processor is a very small special purpose programmable computer capable of handling digital words of conventional form. In the present application, the micro processor will determine the voting format by grouping the number of candidates or voting positions scheduled for a particular office and control the number of selections for that office. It will permit a voter to erase or change any or all of the selections prior to actuating a final vote switch by retaining all of the selections in a temporary memory. The micro processor can be programmed to accomodate the voting format for any particular election by addressing it with suitable electrical signals using conventional means.

Data are entered into micro processor 15 from keyboard 16. The keyboard is made up of a number of switches that are actuated by the voter. These switches may be of the mechanical type which require an actual deflection or they may be of the electronic type that are capacitance or resistance sensitive and require no actual mechanical force. The keyboard actuates micro processor 15 through a series of buffers 17 which act to condition the keyboard signals for use by the micro processor.

Data entered into the scratch pad memory are displayed on a display panel 18 in the form of illuminated regions as explained above. Each illuminated region can be accomodated by a separate electric lamp. These lamps may be conventional filament type lamps, gas tubes or electroluminescent lamps. The latter are preferred because of their low power consumption, high reliability and long life. The lamps are operated by means of buffers and amplifiers 19.

The micro processor 15 is programmed by the voting attendants using a portable programmer 20 which applies the desired electrical signals through buffers 21. If desired, the programmer can be a card actuated device located in a locked access portion of the EVM. Once the EVM is programmed, it will be in a fixed mode of operation for the duration of the election.

When the voter is satisfied that his selections are as desired, he actuates the "clear" switch **16*a*. This switch operates circuits that transfer the data in the scratch pad memory to a permanent memory 23. Operation of clear switch 16*a* signals the termination of the ballot and micro processor 15 applies a lockout signal to keyboard 16 by way of line 25. This action prevents further data entry and records the actual vote. The clear switch 16*a* can be a keyboard element, appropriately marked, or it can be automatically operated by the action of the voter leaving the voting booth. The permanent memory 23 can be of the conventional magnetic variety. If desired, a printer 24 can produce a parallel permanent visual read out or tally of the vote. The EVM will remain locked out until reset 26** is actuated. This reset is actuated by the voting attendant and is located for his use only. The reset will be actuated when a voter has been verified and has entered the booth. While not shown, it is to be understood that all of the above-described circuits and elements are supplied with, for example, power from the normally available power mains. While the micro processor includes a great many actual circuits, the present state of the art devices consume relatively little power. This characteristic makes the use of secondary or stand-by power readily feasible. For example, when using the power mains, a stand-by battery can be maintained on trickle charge. In the event of a power failure or severe power reduction, the battery can be switched on to operate the machine so that voting can continue uninterrupted.

Returning to FIG. 2, a preferred form of display will now be described. The face of the display shown is divided into three rectangular areas designated 30, 31 and 32.

In area 30, there are two rows of blocks. The right-hand row of blocks have no associated keyboard switches and are always illuminated. The various offices to be voted appear in illuminated blocks 33. To the left of each office block is a block 34 which is used for write-in votes. In one type of device, a paper tape roll is located behind blocks 34 and is indexed each time a write-in vote is tallied. To write in a candidate, the voter raises the cover on block 34 for the associated office and writes in his selection on the thus exposed paper tape. Raising the cover actuates a keyboard switch which, by way of the micro processor 15, blocks out the required number of other keyboard positions associated with that office thus avoiding multiple voting. At the same time, the micro processor 15 is notified of a write-in vote. Its instructions will cause the paper tape to index upon completion of the ballot. Alternative write-in voting mechanisms could be used. For example, write-ins could be made on cards which are then dropped in chutes located behind the covers 34 and collected in suitable containers. The card insertion could be sensed electronically to notify the micro processor of the write-in vote.

In area 31, voter propositions are printed in blocks 36 which are continuously illuminated. To the right of each block 36 are two selection switches, a "yes" switch 37 and a "no" switch 38. Whichever switch is touched will activate the indicated vote and the switch thus selected will be illuminated. Touching the alternate switch will change the vote so that the last selected switch will determine the vote to be tallied.

In area 32, a series of rows and columns of blocks are shown. The blocks at the top of each column shows the party. The blocks in the columns contain the names of the candidates of the indicated party. The rows are arranged to align with the office shown in labels 33. If the voter desires, he can vote for a candidate by touching each candidate block of his selection. The micro processor 15 is programmed so that only one candidate (or that number permitted by the election) in a particular office can be selected. If the voter desires to cast a party vote, the desired top or party column block is touched thus actuating the entire column of candidates. The left-hand column of blocks 40 are "erase" buttons to be used when the voter decides that he wants to change his vote. When the "erase" block 40 is touched, the associated row of votes will be cancelled and a new selection can be made. Of course, if a write-in vote in a block 34 has been made as described above, the office related touch actuated positions in area 32 are locked out to the required extent so that only the permitted number can be selected.

Upon completion of voting, the voter is instructed to touch the clear block 41. This action tallies the vote and clears the display. The ballot is recorded on counter 42 which tallies the total number of voters that have used the EVM. The next vote cannot be entered until the voting attendant actuates an enable function (reset 26 of FIG. 3) and admits another verified voter. The completion of a ballot as signaled by the "clear" actuation causes the ballot to be recorded in a permanent local memory 23 and recorded by printer 24. If desired, the EVM can be connected by means of a communications link to a central location where a number of EVMs can be tallied. This means that as each voter completes his ballot his vote is tallied at the central location and available for display. This capability is not of great present interest but is expected to be of future importance.

If desired, the voter identification and EVM enabling function can be remoted or automated by well known techniques.

FIG. 4 shows how the EVM can be incorporated in a system that automatically tallies the votes to provide real-time display of voting as it proceeds. A geographic voting area is made up of a plurality of districts 50 connected by ordinary telephone lines 51 to a central polling station 52. While telephone lines are shown, radio or optical links could be employed. Each district 50 includes a plurality of precincts 53. Each precinct may contain one or more EVM units as required. Ordinarily, all communications are by voice relay and physical means are used to transport the actual voting results. Such means are fully useful in the present EVM and in fact the write-in and permanent vote tally would ordinarily be physically transported if desired.

FIG. 5 is a block diagram showing a communications system. One or a plurality of EVM 10 units at a precinct have their permanent memory 23 elements connected to read out to a multiplex unit 55 upon receipt of a suitable command. When a district desires to obtain a total vote, the EVM 10 units in the precincts are sent command signals and the permanent memory data in each unit are read out to a multiplex unit 55 which produces a pulse train that indicates the memory data. If desired, a security unit 56 may be incorporated in the form of a scrambler to secure the transmission. The information is applied to a transmission link 57 which sends the data to the district 50. As shown in FIG. 4, the districts 50 are also in communication with a central polling station. This link, which is shown as telegraph lines 51, could use a system similar to that of FIG. 5.

In the case shown using telephone lines, the required signals could be transmitted using a conventional Bell Telephone Company CBS data access arrangement. A multiplex clock rate in the 2 to 6 kilohertz range will permit data rates in the 1200 to 2400 baud range. Using such a system, the central polling area can tally votes as they are cast and provide a continuous display of results.

The record provided by the printer 24 in each EVM 10 can be physically transported to each district or to the central polling station and used as a verifying source in the event of a recount. The paper write-in tapes associated with each EVM 10 are also transported to the districts or central polling station where they are recorded. The write-in tapes and printer tapes can be retained for the statutory period as required by the particular laws governing the election.

As will be seen by a person of ordinary skill in the art, all of the above-described functions are accomplished with well-known state of the electronics art equipment. The novelty of my invention resides in the particular functional arrangement set forth and not in the actual circuitry employed. Clearly, many alternatives and modifications will occur to a person skilled in the art of my invention. For example, while a preferred ballot configuration is shown, others could easily be used. It is therefore intended that the invention be limited only by the following claims.

I claim:

1. An electronic voting machine for use by a voter in casting a vote in an election, said machine comprising:

a display panel, said panel including a plurality of selectively energized light sources located in predetermined regions of said panel and means for locating a transparent overlay on said panel in registry with said regions, said overlay having printed thereon the names of the candidates to be voted upon and the party affiliation of said candidates, a keyboard associated with said panel, said keyboard including a plurality of touch actuated switches with at least one switch being associated with each candidate, a micro processor coupled by buffer means to said switches and to said light sources of said panel, said micro processor including means for accepting programming instructions that determine the responses of said light sources to said switches, said micro processor further including a scratch pad memory for storing the data indicating the nature of the state of said lamps on said panel, means for altering any of the switch selected choices of said voter during the balloting of said voter, a permanant memory for storing the contents of said scratch pad memory, means for transfering the contents of said scratch pad memory to said permanent memory upon completion of the selection process by said voter, means responsive to said transfer for rendering said machine inoperative until a subsequent voter is permitted access to said machine, and means for programming said micro processor to conform the operation of said keyboard to said overlay in accordance with said election.

2. The electronic voting machine of claim 1 wherein said panel and said keyboard are incorporated into a unitary structure and said switches are located in associated relation to said regions.

3. The electronic voting machine of claim 1 wherein a printer is incorporated into said machine, said printer being connected to provide a printed record of the contents of said permanent memory.

4. The electronic voting machine of claim 1 wherein means are provided for connecting said permanent memory to a communications link therein providing remote vote tallying.

5. The eletronic voting machine of claim 1 wherein write-in vote recording means is incorporated into said machine, said write-in means comprising:

an access door with each office imprinted upon said overlay, write-in vote accepting means positioned under each of said doors, a switch associated with each of said access doors, each of said switches being actuated by opening said associated door, and means in said micro processor responsive to the actuation of said door associated switches to lock out at least a portion of the electronic voting for the candidates associated with said door.

6. The electronic voting machine of claim 1 wherein said means for transferring is actuated by the departure of said voter from said machine.

* * * * *